US005140763A

United States Patent [19]

Nichols, IV

[11] Patent Number: 5,140,763

[45] Date of Patent: Aug. 25, 1992

[54] SNOW REMOVAL APPARATUS

[76] Inventor: Charles W. Nichols, IV, 69 Maple Ave., Katonah, N.Y. 10536

[21] Appl. No.: 653,728

[22] Filed: Feb. 11, 1991

[51] Int. Cl.[5] ..... E01H 5/06

[52] U.S. Cl. ..... 37/233; 37/270

[58] Field of Search ..... 37/232, 233, 236, 270, 37/219

[56] References Cited

U.S. PATENT DOCUMENTS

| | | | |
|---|---|---|---|
| 1,383,409 | 7/1921 | Liddell | 37/233 |
| 2,061,585 | 11/1936 | Meyer | 37/233 |
| 2,337,434 | 12/1943 | Washbond | 37/233 |
| 3,199,234 | 8/1965 | Reissinger | 37/233 |
| 3,772,803 | 11/1973 | Cote | 37/233 |
| 4,709,492 | 12/1987 | Watson | 37/232 |
| 4,794,710 | 1/1989 | Häring | 37/232 |

FOREIGN PATENT DOCUMENTS

| | | | |
|---|---|---|---|
| 975035 | 11/1964 | United Kingdom | 37/232 |

*Primary Examiner*—Randolph A. Reese
*Assistant Examiner*—Arlen L. Olsen
*Attorney, Agent, or Firm*—Cobrin, Feingertz & Gittes

[57] ABSTRACT

A secondary snow removal structure is attached to the back of a primary snow removal device. The secondary structure includes a plurality of individual fingers positioned and arranged to extend below the level of the lower edge of the primary snow removal device for engagement with the surface being cleaned. A separate spring biasing means is provided for each finger for independently extending each finger to follow uneven portions of the surface being cleaned and thereby loosen and remove residual snow and ice compacted and left by the primary device.

7 Claims, 3 Drawing Sheets

SNOW REMOVAL APPARATUS

BACKGROUND OF THE INVENTION

1. Field of the Invention

The invention relates to apparatus for removal of snow, slush, or ice from highways, airport runways, or other travel surfaces such as driveways, sidewalks and the like (hereinafter referred to as "travel surfaces"). The invention is particularly useful for the removal of snow and ice from travel surfaces which have irregularities in contour; e.g. depressions, potholes, etc.

2. Description of the Prior Art

In removing snow from travel surfaces, it is common to use a snowplow blade, which is attached to the front of a vehicle that is capable of moving in the snow, such as a truck, a tractor or an all-wheel drive vehicle.

It is recognized that snow blowers have been used in the past but their use has been limited to narrow travel surfaces, such as walkways, driveways, etc.

When using snowplow vehicles, the downward travel of the snowplow blade is usually limited, such as by means of skids so as to prevent the bottom edge of the snowplow blade from scraping the travel surface and damaging the same. Even when not limited by skids, the snowplow blade is preferably moved along just above the surface to be cleaned so as to avoid excessive scraping upon that surface and damage thereto. However, because many parts of a travel surface are not flat, there are significant variations in the distance between the lower edge of the snowplow blade and different parts of the travel surface, making snow removal uneven over different parts of the travel surface. This can result in leaving a layer of snow beneath some segments of the lower edge of the snowplow, which snow is compressed by the weight of the snowplow and subsequent passing vehicles, making the travel surface slippery and unsafe. This may necessitate the use of salt, sand, etc. which is expensive to lay down on large travel surfaces. Furthermore, even when the snowplow blade is adjusted so as to be as close as possible to the surface to be cleaned, because of the "crown" which is on some travel surfaces, and because of minute depressions and irregularities therein, there are substantial patches of snow and ice remaining after conventional snow removal.

Various attempts have been made to solve the above-mentioned problem, or similar problems. For instance, in Bunnell U.S. Pat. No. 520,479 (May 29, 1894) for a Road Scraper, the inventor proposed having a segmented lower edge for a road scraper blade, with the edge segments being attached to the main blade by a continuous rubber strip. That arrangement is not presented as a dual blade snowplow, but rather as a scraper for dirt roads which, in theory, will conform to the crown of the road. In that structure, since the individual segments of the blade edge are fairly wide, and since the segments are not completely independent in movement, but are mounted to a common rubber mounting strip, the above-mentioned objective is not completely realized.

U.S. Pat. No. 2,936,537 issued May 17, 1960 to E. C. Bain for a Snow Plow, is directed specifically to a follow-up cleaning of snow left by the snowplow blade. However, that device works by the application of jets of compressed air to the snow missed by the plow, together with a rubber flap to confine the air within a channel behind the plow blade. That system can be effective for loose snow, but is not believed effective for packed snow, or ice or heavy slush. Also, the provision of the air jets presents problems, including the expense of installing and maintaining the compressed air equipment, and the vulnerability of the air jets to clogging.

U.S. Pat. No. 2,962,821, which issued on Dec. 6, 1960, discloses a snowplow having a plow frame and guide pocket members.

U.S. Pat. No. 3,199,234, which issued on Aug. 10, 1965, discloses a snowplow having an obstacle compensating means on the forward edge of the blade. In FIG. 2 it is shown how the snowplow compensates to accommodate an obstacle located on a travel surface.

U.S. Pat. No. 3,808,714, which issued on May 7, 1974, discloses a double-bladed snowplow having an overload release.

U.S. Pat. No. 2,061,585, which issued on Nov. 24, 1936, discloses a snowplow blade for clearing tracks.

U.S. Pat. No. 1,922,998, which issued on Aug. 15, 1933, discloses a combined pan scraper shovel and broom which obviously has limited utility for large road surfaces.

U.S. Pat. No. 1,432,352 discloses a snowplow that is attached to a locomotive for clearing railroad track.

U.S. Pat. No. 1,383,409, which issued on Jul. 5, 1921, discloses a snowplow which can be affixed to the front of an automobile.

Russian Patent 400669 discloses a snowplow of general interest.

The references discussed, while teaching snowplow blade structure and snow removal, do not teach a simple economical means for effectively removing snow from uneven surfaces.

SUMMARY OF THE INVENTION

Objects of the Invention

It is therefore an object of the present invention to provide an improved means for removing snow and/or ice and/or slush and/or combinations thereof from a travel surface.

Yet another object of the present invention is to provide an improved apparatus for removing snow, ice and/or slush and/or combinations thereof from uneven portions of a travel surface so that a minimal residue of the snow, ice and/or slush is left.

A further object of the present invention is to provide an improved snow removal apparatus which can effectively remove snow from uneven surfaces of a travel surface yet is reliable in operation and can be easily maintained.

Accordingly, it is an object of the present invention to provide an improved snow removal apparatus for travel surfaces which is simple and economical and which is capable of loosening and substantially cleanly removing packed snow and/or loose or compressed ice and slush from a travel surface.

Further objects and advantages of the invention will be apparent from the following description and the accompanying drawings.

Brief Description of the Invention

In carrying out the invention, there is provided an improved snow removal apparatus for substantially flat travel surfaces comprising at least one primary (i.e., forward) snow removal blade and a secondary removal blade structure attached to the back of said primary snow removal blade and extending over substantially the entire primary snow removal blade width, said secondary blade structure comprising a plurality of individual fingers positioned and arranged to extend below the level of the lower edge of said primary snow removal blade for engagement with the surface being cleaned. A separate spring biasing means is provided for each of said fingers for extending each of said fingers, with each of said fingers being yieldable to accommodate uneven portions of the hard surface being cleaned while loosening snow and ice left on the surface by said primary snow removal blade device.

A preferred feature of the present invention is to offset the fingers at an angle so as to scrape the hard surface rather than "grab" a pothole and break. A preferred angle is in the range of 100 to 200 degrees.

DESCRIPTION OF PREFERRED EMBODIMENTS

Figure 1:
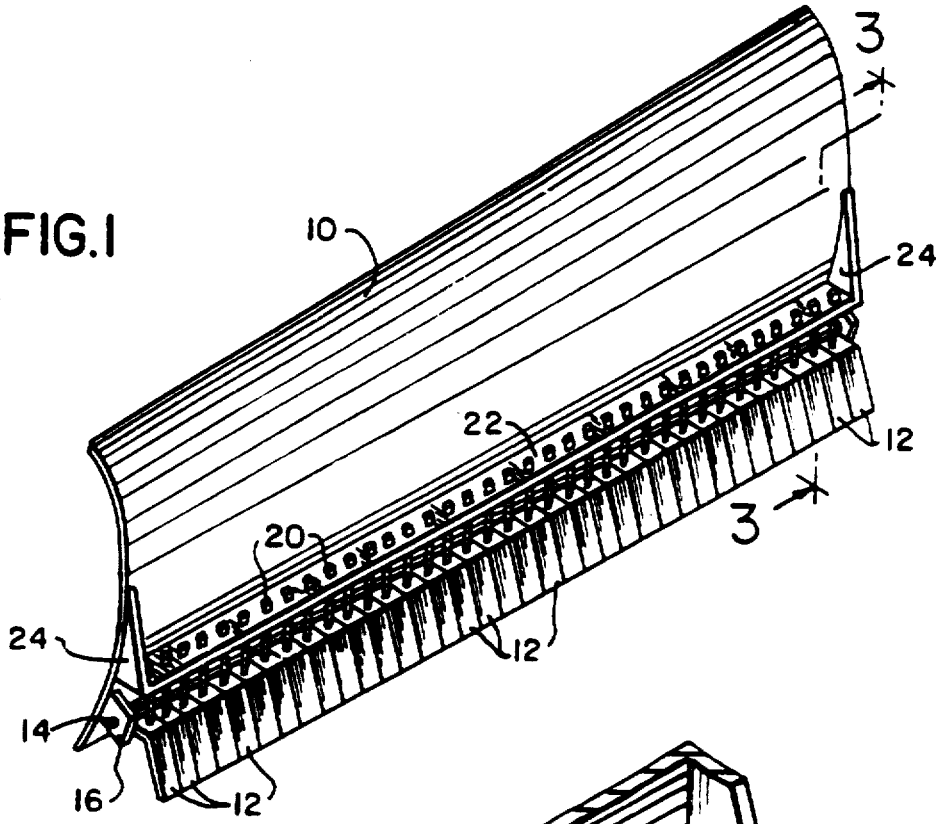
FIG. 1 is a rear perspective view of the present invention.

Referring more particularly to FIG. 1, the invention is illustrated in combination with a primary snow removal blade consisting of a snowplow blade 10. FIG. 1 is a rear perspective view of the apparatus of the invention. For purposes of clarity in presentation, the mounting and attachment brackets which are normally provided on the back of a snowplow blade for attachment of the blade to a drive vehicle have been omitted. However, it will be understood that such mounting supports and brackets must be provided, are conventional and do not form a part of the present disclosed or claimed invention.

In accordance with the present invention, attached to the back of the primary snow removal blade 10 is an entire row of individual finger devices 12, which, together with supporting and positioning hardware, form a secondary blade. These fingers are positioned and arranged to extend below the level of the lower edge of the primary blade 10 where said primary blade 10 is engaged (i.e., elevated from the traveling surface in its uppermost position) for engagement with the surface being cleaned. Each finger 12 is separately spring biased for independently extending each of the fingers 12 down to the surface to be cleaned. Each of the fingers is independently yieldable to accommodate for uneven portions of the travel surface being cleaned, while loosening snow and ice left on the surface by the primary snow removal blade. Each of the fingers is preferably narrow so as to follow the contour of the surface faithfully. In one embodiment, the fingers are one and one-half inches wide. The preferred width is no greater than two inches. Preferably the fingers are of the same width and can be individually replaced.

Figure 2:
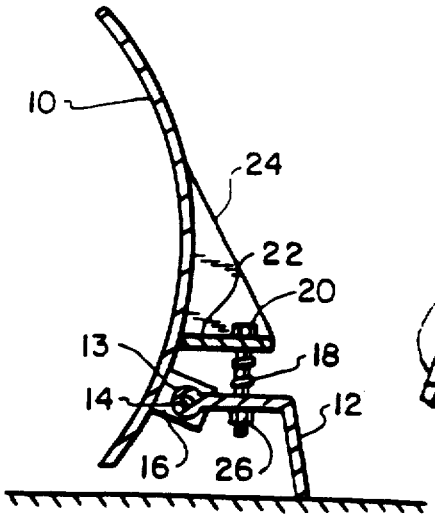
FIG. 2 is a side sectional view of the apparatus of FIG. 2.
Figure 3:
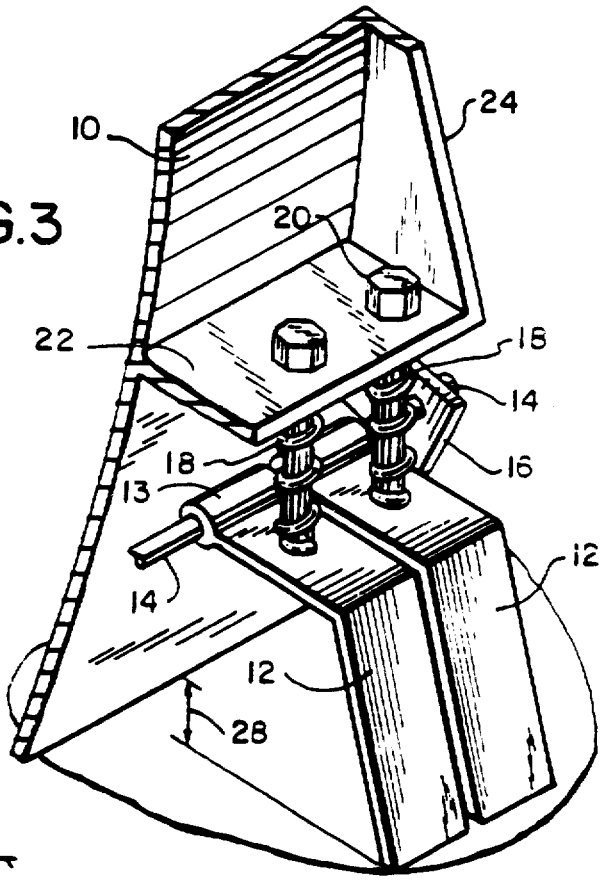
FIG. 3 is an enlarged sectional prospective view taken at section 3—3 of FIG. 1.
Figure 3A:
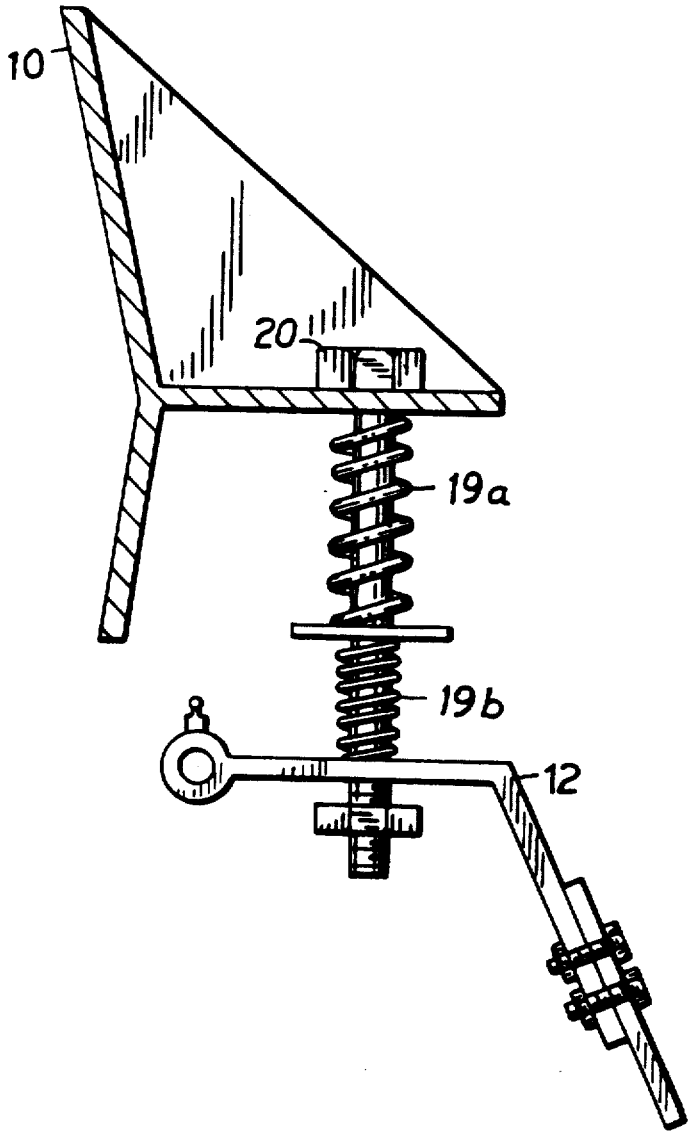
FIG. 3A is an alternate embodiment of the present invention.

In a preferred embodiment, the spring bias for each of the fingers is provided by a separate compression spring 18 (FIGS. 2 and 3). Alternatively, as shown in FIG. 3A, two compression springs 19*a* and 19*b* are provided for. The ratio of the spring constant for the two springs of FIG. 3A is approximately 1:2.5. The weaker spring allows itself to be compressed relatively easily so that the lower edge of the surface can be easily brought in contact with the traveling surface while the stiffer spring thereafter makes further movement of the springs more difficult. Preferably spring 19*b* is the weaker spring and spring 19*a* the stronger spring. A washer 21 is located between springs 19*a* and 19*b*.

FIG. 2, which is a sectional end view of the preferred embodiment of FIG. 1, and enlarged somewhat, illustrates some features of the structure more clearly. As shown in FIG. 2, as well as in FIG. 1, each finger 12 is preferably formed as an inverted L-shaped device with a built-in structure 13 at the upper end for attachment to a pivot pin 14.

One possible embodiment would have grease fittings on the upper end of the fingers through which the pivot pin slides in order reduce friction. The pivot pin 14 may be common for all of the fingers, and is supported by a series of brackets 16 which are welded to the back side of the snowplow blade 10 at spaced intervals along the pivot pin 14. The intermediate brackets 16 are positioned between adjacent fingers 12. The edges of the fingers adjacent to brackets 16 may have cut-out portions to accommodate for the brackets.

If desired, the fingers can have a detachable attaching means near the free end thereof so as to facilitate the replacement of a portion of the vertical segment thereof, which segment may wear due to contact with the traveling surface. These segments which do the scraping may be made of metal, plastic or some other durable substance.

The spring bias is provided by a compression spring 18 (or springs 19*a* and 19*b*) which is positioned by a guide bolt 20 within the spring, and which is compressed between the upper surface of the upper leg of the finger 12 and the lower surface of a shelf member 22. The shelf member 22 is also welded to the back of the snowplow blade 10 and preferably includes reinforcement pieces 24. While only two of the reinforcements 24 are illustrated in FIG. 1, it will be understood that additional reinforcements may be spaced along the shelf member 22, if necessary or desirable. While shown as substantially horizontal, shelf 22 may be tilted slightly upwardly, if desired.

The maximum lower extension of each finger is determined by the length of the bolt 20, and the adjustment of the associated plastic washer nut 26 at the lower end of the bolt. Thus, the bolt acts as a stop for the finger which determines the maximum downward extension of the finger. As clearly illustrated in FIG. 2, the fingers 12 are normally extended below the lower edge of the primary snow removal device 10 so as to scrape the surface being cleaned to pick up any snow or ice or slush or combination thereof which may be in a compounded form left by the primary snow removal device 10.

FIG. 3 is an enlarged partial sectional view of the apparatus of FIG. 1 in which the section is taken at 3—3 of FIG. 1. In FIG. 3, the difference in the level of the lower extension of fingers 12 and the lower extension of the blade 10 is clearly indicated at 28.

Figure 4:
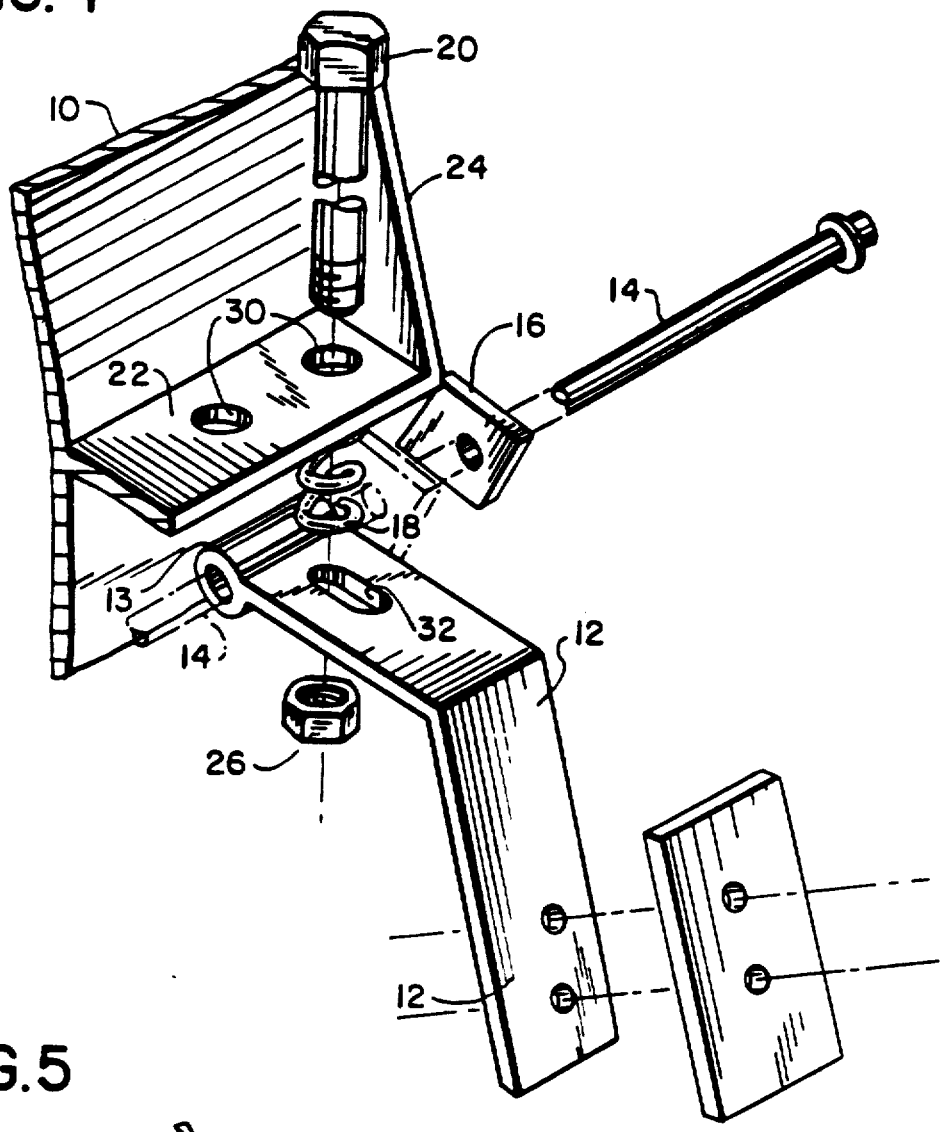
FIG. 4 is an exploded view corresponding to FIG. 3.

FIG. 4, which is an exploded view of the structure illustrated in FIG. 3, further illustrates the details of the preferred embodiment. As particularly indicated in FIG. 4, through holes 30 and 32 must be provided in the shelf 22 and in the finger 12 to accommodate the bolt 20. As shown in the drawing, the through hole 32 in the finger 12 is preferably slotted so as to accommodate for different angles of rotation of the finger.

While the bolts 20 are illustrated as having bolt heads positioned at the top, and nuts 26 positioned at the bottom, it will be understood that these bolts may be reversed, placing the nuts 26 at the top. This alternative arrangement of the bolts is actually preferred since it permits ease of adjustment.

Figure 5:
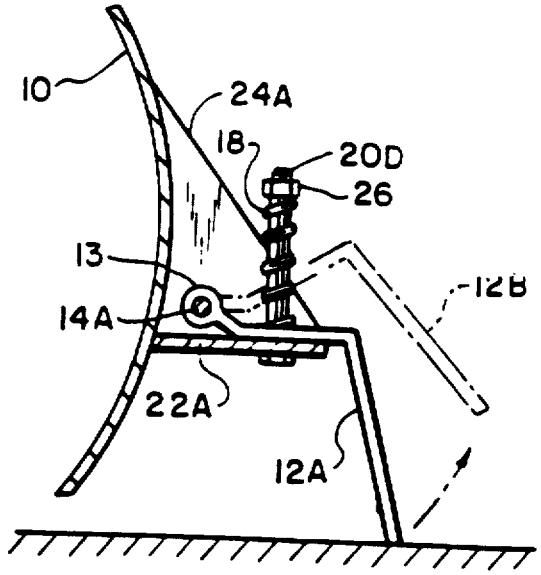
FIG. 5 is a sectional side view corresponding to FIG. 2, and illustrating a modified form of the structure of the invention.

FIG. 5 is a sectional end view corresponding to FIG. 2, and illustrating an alternative embodiment of the invention in which the lower extended position of each finger 12A is determined by abutment of the lower surface of the upper portion of that finger against a shelf member 22A. In this arrangement, the compression spring 18 pushes the surface of the finger 12A down against the shelf member 22A. The adjustment of the nut 26 on the bolt 28 simply determines the degree of compression of the spring 18 (or springs 19*a* and 19*b*) determining the resistance which that spring(s) will exert with respect to the finger 12A. In this embodiment, the bolt may be welded to the shelf 22, and may simply constitute a welded stud butt-welded to the upper surface of the shelf 22A. The raised position of finger 12A is shown at 12B.

As shown in the drawings, the fingers are preferably formed of a substantially flat material with the wide dimension of each finger being substantially parallel to the body of primary snowplow blade 10. Also, it is a feature of the invention that the individual fingers are normally aligned substantially parallel, as shown especially in FIG. 1, with the edges of the fingers closely spaced together so that the fingers substantially enclose a tunnel-like structure for guiding material scraped loose by the fingers to the side of the road. This action is especially effective when the primary snow removal blade 10, is advanced against the snow which is being removed at an angle, as is conventionally done, so as to effectively discharge snow to one side of the path which is being cleared.

The material from which the fingers are made may preferably be substantially rigid material. However, some resilience in the material is acceptable.

If desired, the fingers may have detachable attaching means so that the lower portions of the fingers, if worn from continuous scraping, can be removed and replaced by new lower portions facilitating the longevity of the present invention.

Also, if desired, the fingers may be formed from a spring material, so that the resilient spring biasing effect is accomplished substantially by the material of the fingers themselves. In such an arrangement, the springs 18 (or the net effect of 19*a* and 19*b*) may be relatively stiff, or may be omitted completely. In such an arrangement, the fingers are firmly attached to the shelf 22 or 22A, and are preferably somewhat longer than as illustrated in the drawings.

While a substantially L-shaped finger having an inside angle of about 110 degrees is the preferred configuration, it will be apparent that the fingers 12 and 12A may have other shapes. For instance, the fingers may be somewhat curved, as long as the functional effect is the same as shown and described.

While shown as adapted to a solid plow blade, the invention may also be used with a blade of the type having a lower blade edge which is independently releasable to avoid blade damage from contact with rocks, curbs, or other obstructions.

While the preferred embodiment has been shown and described in connection with a primary snow removal device consisting of a snowplow blade, it will be apparent that the primary snow removal device may be a snow blower. The application of the features of the invention in a combination including a snow blower as the primary snow removal device will be apparent, and can be carried out in a manner similar to that illustrated for the snowplow blade, as shown and described.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. An improved snow removal apparatus comprising at least one primary snow removal blade structure and a secondary snow removal blade structure attached to the back of said primary snow removal blade structure and extending over substantially the entire primary snow removal blade width, said secondary snow removal blade structure including a plurality of individual fingers wherein each of said fingers has an upper finger portion extending rearwardly and above the lower portion of the primary snow removal blade and a lower finger portion angularly extending rearwardly from the upper finger portion and positioned and arranged to extend below the level of the lower edge of said primary snow removal blade structure for engagement with the surface being cleaned, spring biasing means for each of said fingers for extending each of said fingers, each of said fingers being yieldable independently of the others of said fingers to accommodate for uneven portions of the surface being cleaned while loosening snow and ice left on the surface by said primary snow removal blade structure and each of said fingers being formed of a substantially flat material with the wide dimension of each finger being substantially parallel to the body of said primary snow removal blade structure.

2. An improved snow removal apparatus according to claim 1, wherein said individual fingers are normally aligned substantially in parallel and with the edges of adjacent ones of said fingers being closely spaced so that said fingers substantially enclose a tunnel-like structure for continuously guiding material scraped loose by said fingers to the side of the surface being cleaned.

3. Apparatus as recited in claim 1, wherein each of said fingers is hingedly attached at the upper finger portion thereof to said primary snow removal blade structure, said hinged attachment being carried out by a common hinge pin for all said fingers, the with spaced positioning brackets for supporting said common hinge pin and attaching said common hinge pin to said primary snow removal blade structure and each of said spring fingers being in the form of an inverted letter L when viewed from the side; and wherein said separate spring biasing means for each of said fingers comprises at least one helical compression spring.

4. Apparatus as claimed in claim 3 wherein the upper finger portion is a shelf structure attached to said primary snow removal blade structure, said shelf structure being engageable by each of said biasing springs to provide a reference point from which said springs exert the spring biasing force to the associated fingers.

5. Apparatus as claimed in claim 4, wherein a bolt is provided and threaded through the center of each of said biasing springs to hold the associated spring in position, each finger including an opening for accommodating the bolt, and the associated bolt extending through said finger.

6. Apparatus as claimed in claim 5, wherein said separate spring biasing means for each of said fingers substantially comprises a spring material from which said fingers are formed.

7. Apparatus as claimed in claim 5 wherein two helical compression springs are provided for each finger, said two helical compression springs having different spring constants.

* * * * *